US007845066B2

(12) United States Patent
Chang et al.

(10) Patent No.: US 7,845,066 B2
(45) Date of Patent: Dec. 7, 2010

(54) METHOD OF INSTALLING AN ANTENNA OF A NOTEBOOK COMPUTER

(75) Inventors: Daniel Chang, Pa-Te (TW); Chia-Lun Tang, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 400 days.

(21) Appl. No.: 11/876,576

(22) Filed: Oct. 22, 2007

(65) Prior Publication Data

US 2009/0100666 A1 Apr. 23, 2009

(51) Int. Cl.
*H01P 11/00* (2006.01)

(52) U.S. Cl. ..... 29/600; 29/601; 29/830; 343/700 MS; 343/702

(58) Field of Classification Search ..... 29/600–601, 29/830–832; 343/700 MS, 786, 702, 846–848; 455/90.3

See application file for complete search history.

(56) References Cited

U.S. PATENT DOCUMENTS 5,966,098 A * 10/1999 Qi et al. ..... 343/702
6,181,834 B1 * 1/2001 Li et al. ..... 382/298
6,285,328 B1 * 9/2001 Masaki et al. ..... 343/702
6,980,159 B2 * 12/2005 Sun et al. ..... 343/702
7,072,690 B2 * 7/2006 Shin et al. ..... 455/557
7,215,286 B2 * 5/2007 Chen ..... 343/700 MS
7,262,701 B1 * 8/2007 Nguyen ..... 340/572.7
7,388,503 B2 * 6/2008 Posamentier ..... 340/572.8
7,505,004 B2 * 3/2009 Chen et al. ..... 343/702
2007/0040754 A1 * 2/2007 Liu et al. ..... 343/702

* cited by examiner

*Primary Examiner*—Minh Trinh
(74) *Attorney, Agent, or Firm*—Guice Patents PLLC

(57) ABSTRACT

A method of installation of a notebook computer antenna, the method is mainly to design to use a mode of manufacturing tags to make groups of or integrate antenna sections required by the notebook computer to make a tag antenna; then the tag antenna is stuck and fixed on an inner layer of the housing of the notebook computer. This method can reduce cost of manufacturing and thickness and weight of notebook computers.

7 Claims, 3 Drawing Sheets

METHOD OF INSTALLING AN ANTENNA OF A NOTEBOOK COMPUTER

BACKGROUND OF THE INVENTION

1. Field of the Invention

The present invention relates to a method of installing an antenna, and especially to a method of manufacturing a plurality of antenna sections of different bandwidths and sticking the same on an inner layer of the housing of a notebook computer.

2. Description of the Prior Art

Following fast development of the wireless communication technique, various wireless communication systems has their respective applicable ranges of frequency. The ranges of frequency of the notable Global Positioning System (GPS) are: L1 band using 1575.42 MHz, L2 band using 1227.60 MHz; the range of frequency of Global System for Mobile Communication (GSM) is: 890~960 MHz; the range of frequency of Digital Communication System (DCS) is 1710~1880 MHz; the range of frequency of Personal Communication Service (PCS) is 1850~1990 MHz; the range of frequency of Integration of Mobile and Fixed Network (IMT-2000 (3G)) is 1920~2170 MHz; the range of frequency of the Bluetooth is 2440~2484 MHz (IEEE 802.11b); and the range of frequency of the Ultra Wideband Communication (UWB) is 3.1~10.6 MHz. (Note: these ranges of frequency may be slightly different in pursuance of different districts).

By the fact that each kind of wireless communication system has its own range of frequency, the equipment of mobile communication must uses matched antennas designed in accordance with their own ranges of frequency.

And following large increasing of ability of notebook computers in the present days, the notebook computers can be in the built-in type applicable to all the mobile communication equipment; to meet different wireless communication systems, there must be various antennas in order to be provided in the housings of notebook computers. Under the requirement of compactness on notebook computers, the antennas installed in the notebook computers mainly are planar antennas.

The method of installation of an antenna in a conventional notebook computer is to make a planar antenna from metallic sheets, and then to fix the antenna in the housings of the notebook computer, for instance in a housing around a display screen, by using fixing means such as using screws.

Such a method of installation must induces increasing of working hour for installation process when an antenna is applied to a plurality of ranges of frequency; and by the fact that the fixing means such as using screws makes a notebook computer thicker and heavier, it is contrary to the requirement for compactness, thus improvement is wanted.

SUMMARY OF THE INVENTION

In view of the defects resided in the method of installation of notebook computer antennas of the conventional notebook computers, the present invention provides a brand new technique of antenna installation that can make easy and fast installation of a plurality of antenna sections with different ranges of frequency, and can reduce cost and thickness and weight of notebook computers.

The method of installation of notebook computer antennas of the present invention is mainly to design to use a mode of tag manufacturing labels to make groups of or integrate antenna sections required by the notebook computer, thus a tag antenna is made; then the tag antenna is stuck and fixed on an inner layer of the housing of the notebook computer.

The method of installation of the notebook computer antenna of the present invention can combine signal lines of each antenna into one soft bus line in favor of connecting to one of various kinds of communication equipment.

The method of installation of the notebook computer antenna of the present invention can make an antenna with a monolayer or multiple layers.

The method of installation of the notebook computer antenna of the present invention can further have the antenna left with at least an opening to make spaces for peripheral equipment (such as a camera module, a set of horns etc.) of the notebook computer.

The present invention will be apparent after reading the detailed description of the preferred embodiment thereof in reference to the accompanying drawings.

DETAILED DESCRIPTION OF THE PREFERRED EMBODIMENT

The method of installation of notebook computer antennas of the present invention includes the following steps:

a) making a tag antenna, the tag antenna is designed by using a mode of making groups of or integrating a plurality of antennas required by the notebook computer, and is manufactured following a tag manufacturing process; and b) sticking and fixing the tag antenna on an inner layer of the housing of the notebook computer.

Figure 1:
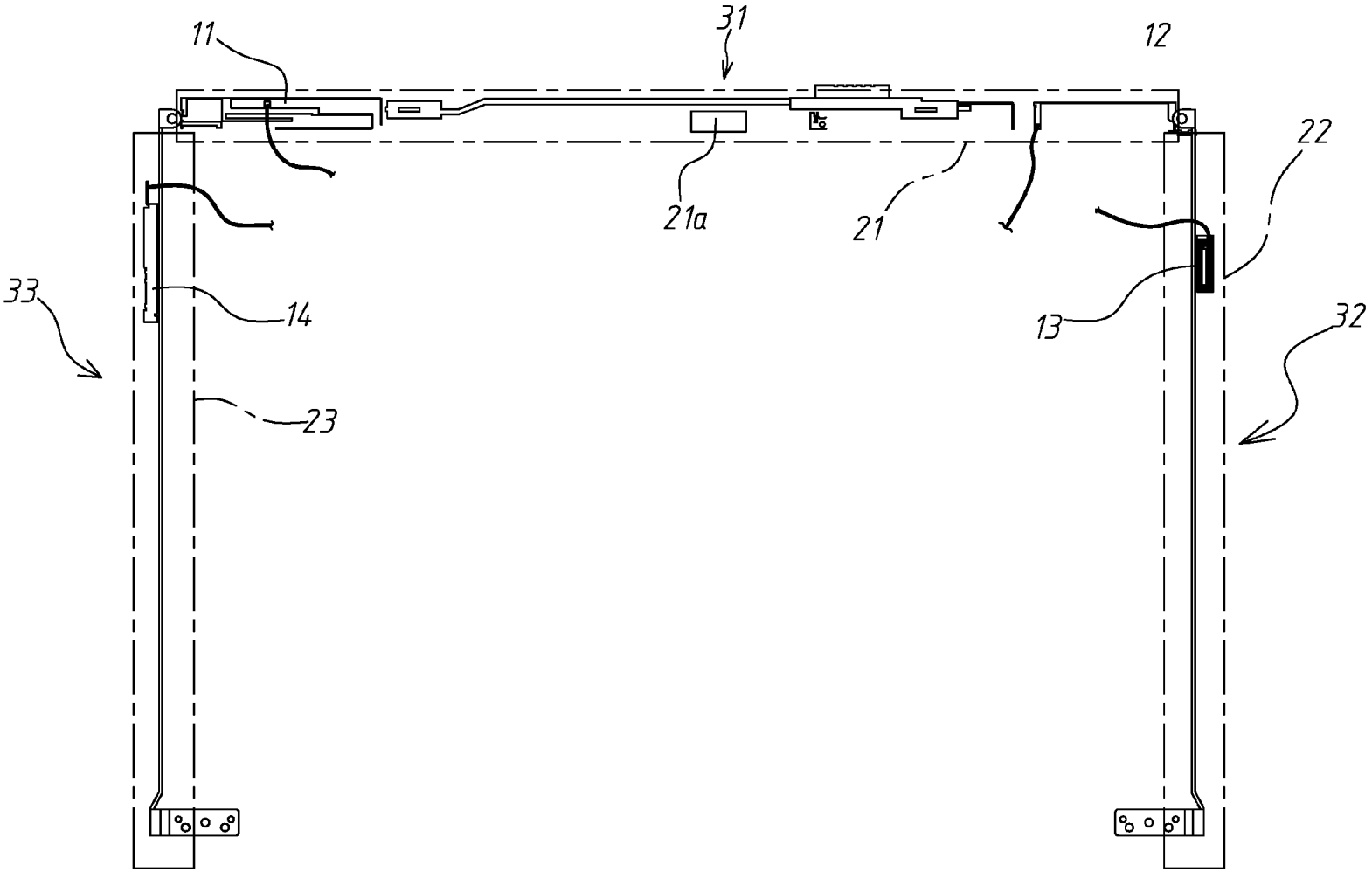
FIG. 1 shows the first step of making a tag antenna of the present invention.

Referring to FIG. 1 which shows the first step of the present invention to design to use a mode of manufacturing tags to make groups of or integrate a plurality of antenna sections required by the notebook computer, to thereby make a tag antenna; in the step, mainly a first tag film 21 is made to get a first planar antenna 11 of the type of WWAN/GPS and WiMAX/WLAN, and to get a second planar antenna 12 of the type of WiMAX/WLAN and WALN, they are designed to be on the housing of a display screen of the notebook computer; and a second tag film 22 is made to get a third planar antenna 13 of the type of FM, it is designed to be on the right side of the housing of the display screen of the notebook computer; a third tag film 23 is made to get a fourth planar antenna 14 of the type of UWB and Bluetooth. The tag antenna of the present invention includes an upper tag antenna section 31, a right tag antenna section 32 and a left tag antenna section 33 that can be manufactured in a mode of making groups or integrating.

Figure 2:
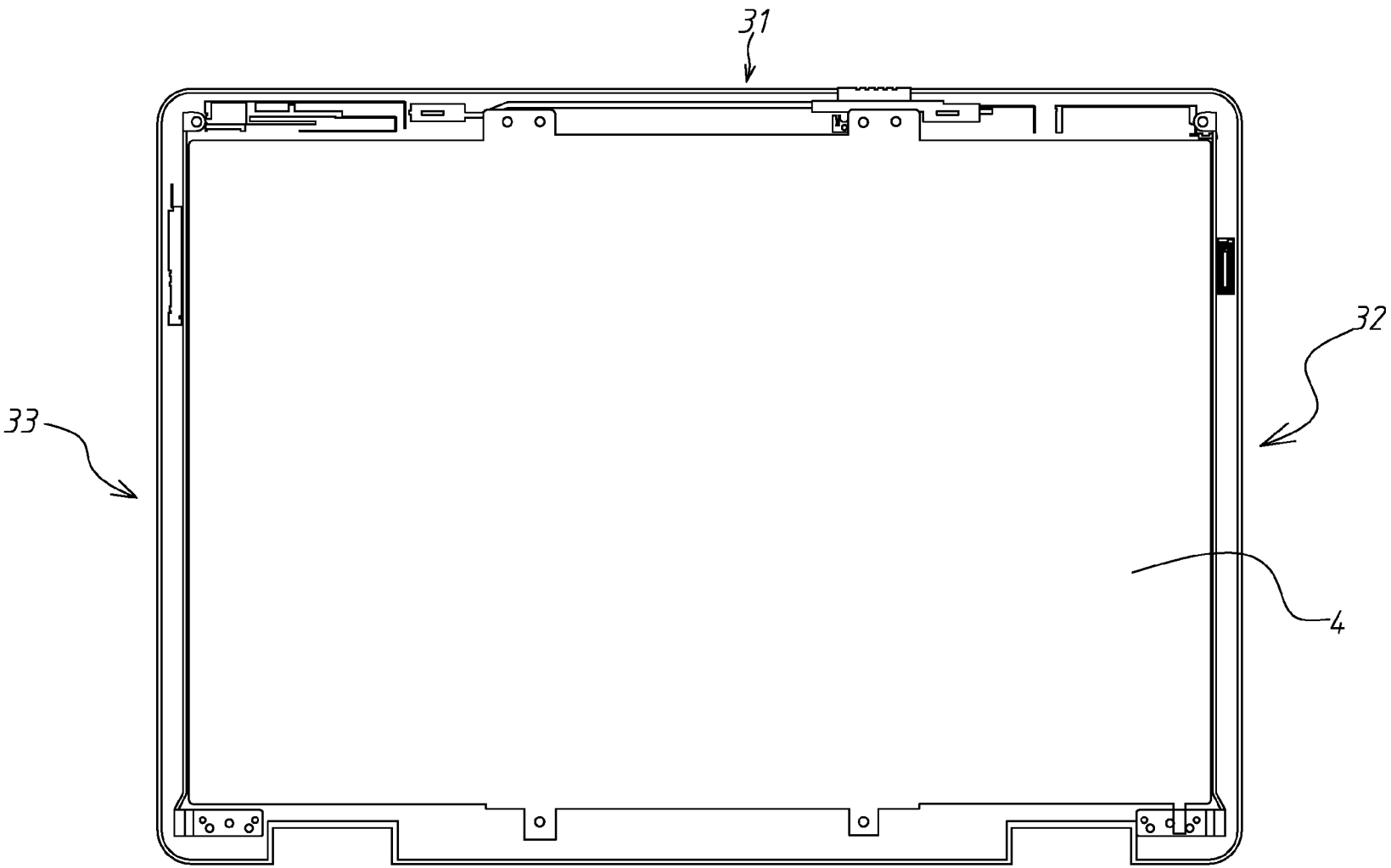
FIG. 2 shows that the tag antenna of the present invention is stuck on of a periphery of a notebook computer.

In FIG. 2 which shows that the tag antenna sections 31, 32 and 33 of the present invention are stuck and fixed on of a periphery on an inner layer of the housing of the notebook computer, for instance on an inner layer of a housing 4 around a display screen.

In installation by the method of the present invention, it needs only to stick the label type antenna made on their respective correct places to complete the installation, and no fixing means such as using screws is required; this will make antenna installation very easy and fast, and can reduce cost and thickness and weight of notebook computers.

And more, the steps of manufacturing a tag of the present invention are:

i) to cut at least a metallic sheet to get a plurality of metallic radiation layers in shapes of a plurality of antenna sections for the notebook computer;

ii) to form a first adhesive layer by applying glue on one side of each of the metallic radiation layers;

iii) shaping a tag film by punching molding;

iv) using a set of press combining equipment to stick uniformly the tag film on the first adhesive layer on the one side of each of the metallic radiation layers to eliminate air bubbles between the tag film and the first adhesive layer;

v) to form a second adhesive layer on another side of each of the metallic radiation layers;

vi) to stick a releasing paper on the second adhesive layers; and vii) to cut said tag film and said releasing paper to form contour of a tag antenna.

In practical installation, the releasing paper on the label type antenna is torn off and stuck on an inner layer of the housing of the notebook computer.

In manufacturing the tag antenna of the present invention, the tag antenna can be provided further with at least an opening 21*a* to leave a space for the peripheral equipment (such as a camera module, a set of horns etc.) of the notebook computer of the present invention. And each antenna section of the tag antenna is connected respectively to a signal line, and all the signal lines of tag antenna can be combined into one soft bus line in favor of connecting different communication equipment. The tag antenna of the present invention can be a structure with a monolayer or multiple layers.

Figure 3:
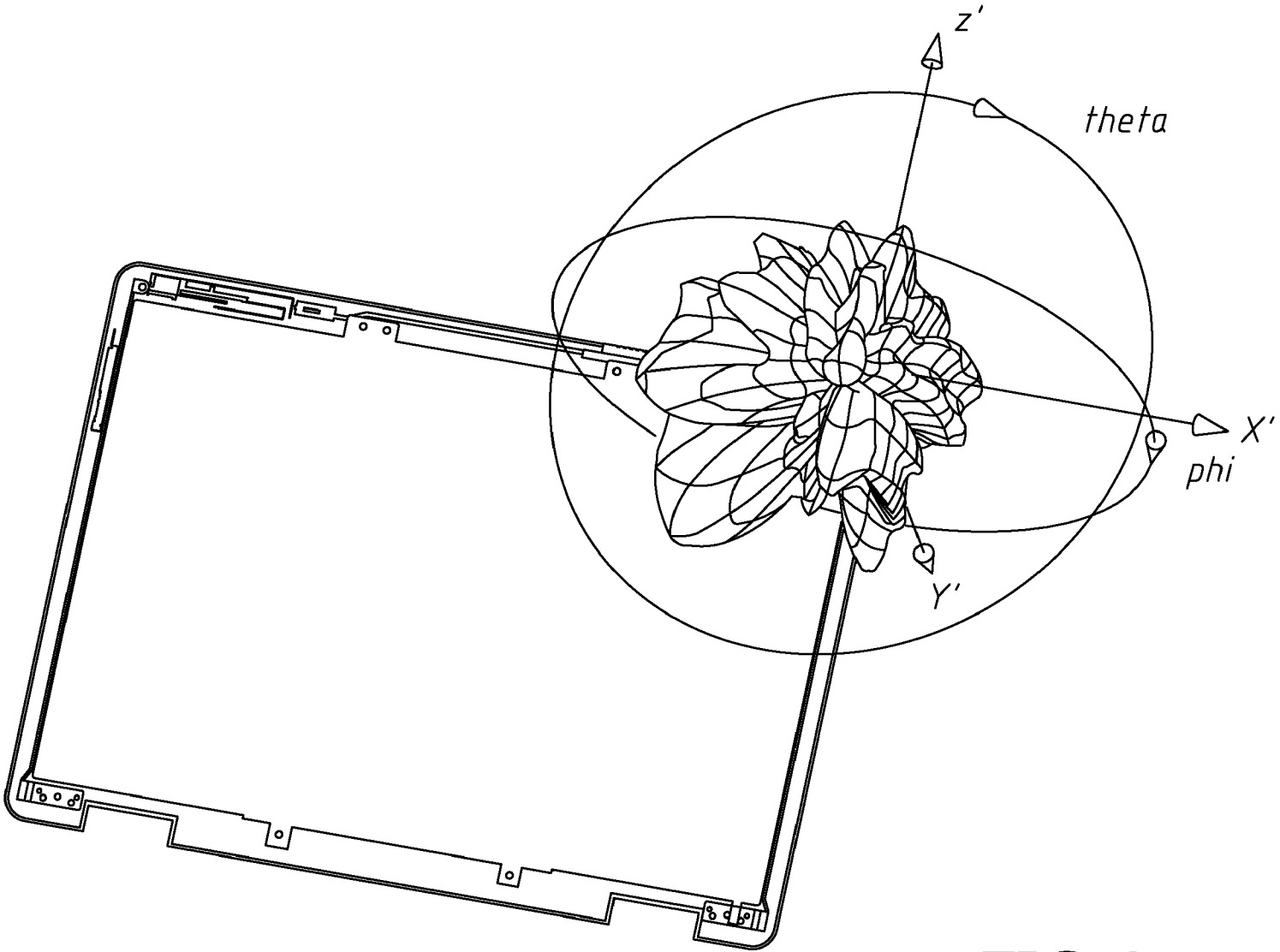
FIG. 3 shows a pattern diagram of 3D field type obtained by a simulation test.

Referring to FIG. 3, it shows a pattern diagram of 3D field type obtained by a simulation test.

The preferred embodiment is only for illustrating the present invention, and not for giving any limitation to the scope of the present invention. It will be apparent to those skilled in this art that various modifications or changes such as increasing or reducing of the amount of planar antenna or positions allocated for them shall also fall within the scope of the appended claims.

The invention claimed is:

1. A method of installation of an antenna for a notebook computer comprising the steps of:

a) manufacturing a tag antenna by integrating a plurality of antenna sections as required by said notebook computer; and b) sticking and fixing the tag antenna to an inner layer of a housing of the notebook computer;

wherein the manufacturing step a) includes the steps of:

i) cutting at least one metallic sheet to produce a predetermined number of metallic radiation layers in shapes of said plurality of antenna sections for said notebook computer;

ii) forming a first adhesive layer by applying glue to a first side of each of the predetermined number of metallic radiation layers;

iii) shaping a tag film by punching and molding;

iv) sticking the tag film on the first side of each of the predetermined number of metallic radiation layers of the first adhesive layer and preventing air bubbles between the tag film and the first adhesive layer utilizing a set of press combining equipment;

v) forming a second adhesive layer on a second side of each of the predetermined number of metallic radiation layers;

vi) sticking a releasing paper on the second adhesive layer; and vii) cutting the tag film and the releasing paper and forming a contour of the tag antenna.

2. The method according to claim 1, wherein each of the predetermined number of metallic radiation layers of said tag antenna is connected respectively to a signal line of a predetermined number of signal lines.

3. The method according to claim 2, wherein the predetermined number of signal lines of said tag antenna are combined into one soft bus line.

4. The method according to claim 1, wherein the tag antenna has at least one layer.

5. The method according to claim 1, wherein the tag antenna is locate on a periphery of a display screen of the notebook computer.

6. The method according to claim 1, wherein the tag antenna is locate on at least three sides of a periphery of a display screen of the notebook computer.

7. The method according to claim 1, wherein said tag antenna has at least one opening providing space for peripheral equipment of the notebook computer.

* * * * *